US007421859B2

(12) United States Patent
Schmidt

(10) Patent No.: US 7,421,859 B2
(45) Date of Patent: Sep. 9, 2008

(54) LATCH NEEDLE FOR LOOP-FORMING TEXTILE

(75) Inventor: Josef Schmidt, Meßstetten-Unterdigisheim (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/812,589

(22) Filed: Jun. 20, 2007

(65) Prior Publication Data

US 2007/0295034 A1 Dec. 27, 2007

(30) Foreign Application Priority Data

Jun. 21, 2006 (EP) ..... 06012737

(51) Int. Cl.
*D04B 35/04* (2006.01)

(52) U.S. Cl. ..... 66/121

(58) Field of Classification Search ..... 66/116, 66/120–123

See application file for complete search history.

(56) References Cited

U.S. PATENT DOCUMENTS

| | | | | |
|---|---|---|---|---|
| 1,824,445 | A * | 9/1931 | Parlini | 66/117 |
| 2,817,222 | A | 12/1957 | Noe | |
| 3,031,867 | A | 5/1962 | Wiederhut et al. | |
| 4,099,391 | A | 7/1978 | Fukuhara | |
| 4,294,086 | A * | 10/1981 | Mayer et al. | 66/121 |
| 4,601,180 | A * | 7/1986 | Mayer et al. | 66/121 |
| 4,817,398 | A * | 4/1989 | Sos et al. | 66/121 |
| 7,007,516 | B2 * | 3/2006 | Sauter | 66/121 |
| 2002/0152774 | A1 * | 10/2002 | Sauter et al. | 66/121 |
| 2005/0217322 | A1 * | 10/2005 | Sauter | 66/120 |

FOREIGN PATENT DOCUMENTS

| | | |
|---|---|---|
| DE | 27 14 607 | 10/1978 |
| DE | 28 17 136 A1 | 1/1979 |
| EP | 1 584 722 A | 10/2005 |

* cited by examiner

*Primary Examiner*—Danny Worrell
(74) *Attorney, Agent, or Firm*—Norman N. Kunitz; Fitch, Even, Tabin & Flannery

(57) ABSTRACT

A latch needle (1) having a latch (6) provided on its latch spoon on the side facing away from the hook (4), with at least two facets or molded surfaces (10, 11). These facets (11, 11'), which converge toward the latch back (23), decrease the volume of the latch head (8). Consequently, it is possible to reduce the width C of the recess (27), thus resulting in a stabilization of the knitting machine needle (1) in this region.

11 Claims, 7 Drawing Sheets

LATCH NEEDLE FOR LOOP-FORMING TEXTILE

CROSS REFERENCE TO RELATED APPLICATION

This application claims the priority of European Patent Application No 06 012 737.0, filed on Jun. 21, 2006, the subject matter of which, in its entirety, is incorporated herein by reference.

BACKGROUND TO THE INVENTION

The invention relates to a latch needle for a loop-forming machine, in particular for a knitting machine, for the production of flat textiles.

In order to form loops, so-called latch needles are used in machines, in particular in knitting machines, whereby said needles are moved back and forth in rapid succession in order to form loops. In so doing, the latch provided on the knitting machine needle opens and closes a pickup space for a thread in rapid succession and at high speed. This pickup space is limited by the needle base body and by a hook on one end of said needle base body interacting with the opening and closing latch. In so doing, the latch impacts, in rapid succession, alternatively on the hook in order to create the closed position and on the shaft of the latch needle in order to create the open position or rear position. During the loop-forming process, the latch of the latch needle is moved through the loop or the half-loop. The latch speed is highest at the latch tip and decreases as the distance from the fulcrum of the latch—on which it is supported in the knitting machine needle—decreases. The kinetic energy of the latch head at the time of impact must be eliminated on the hook in the closed position and on the needle shaft in open position. To achieve this, a prior-art knitting machine needle 1 in accordance with FIGS. 4, 4*a*, 5*a* and FIG. 7 has on the upper side 37 of its needle body 2 a trough-shape recess 27 or a receiving funnel 15 in the form of an impression. Viewed in cross-section, this is essentially followed by a circular arc and is adapted to the back surface 23 of the latch head 8 that is held by the latch shaft 9. On both its sides, the latch shaft 9 terminates on a line 24 in the latch head 8, said line representing the edge of a facet 10, 10'. The faces or facets 10, 10' extend at an acute angle with respect to each other and adjoin the back surface 23. The latch head 9 is symmetrical with respect to the center axis B and has on its side facing the needle body a width that corresponds to the relatively large width C+ of the recess (FIG. 4*a*).

This relatively large width C+ of the receiving funnel 15, as well as the large mass of the latch head, can lead to problems because this mass must be moved at high speed back and forth between the closed and rear positions. The kinetic energy must be eliminated on the receiving funnel 15 for the latch head. In the open position, this is achieved by the spring action of the support areas of the shaft jaws, which are also referred to as the jaws of the latch needle. This spring action can be affected by an extension of the latch slit or by an additional, second slit in the latch needle.

The forces created at the time of impact of the latch in rear position may be large enough to break the jaws or the latches.

Another stress, to which a machine knitting needle is subjected during loop formation, is created by the tensile forces of the knit material. The machine knitting needle is guided in a needle channel of a needle bed and its needle underside (back of the needle) is supported on the bottom of the needle channel. This channel may terminate in the throat region, i.e., in the region of the receiving funnel of the latch needle.

During the loop-forming operation, the needle moves far beyond the support region of the needle support. In this region, the machine knitting needle is subjected to tensile forces that act in the direction of the needle support. These tensile forces are due to the material takedown. The material take-down already draws knit material away from the needles. The material is held by the needles by half loops located on the needle back. As a result of this, the take-down forces across the half loops act directly on the needle base body which is supported in the needle support. Now, if the half loops are cast off via the closed latches, these tensile forces increase as the half loops move farther in the direction of the needle hook. As a result of this, stress is created that can lead to breakage of the needle shaft. As a rule, the needles break at the receiving funnel or at the mold impression, which represents a weak spot of the latch needle body and is located approximately at the end of the needle support (the so-called cast-off edge), when the knitting machine needle is in moved out position. A mold impression adapted to the prior-art latch head, said impression having a corresponding size, promotes this breaking behavior.

Document DE-OS 28 17 136 discloses a latch needle having a needle shaft with a recess, whereby the shape of the recess is complementary to the back surface of the latch head. The recess is formed by removal of needle shaft material. The support surface of the latch head is limited to the existing width of the lateral walls of the needle shaft, i.e., the needle shaft jaws, whereby the needle shaft is weakened by the removal of the material in order to create the recess. This increases the susceptibility of the latch needle to breakage.

Document DE-OS 22 25 835 discloses a reinforcement of the latch head by means of a lateral rib in order to counteract the wear occurring during the loop-forming process and to counteract the susceptibility to breakage of the latch head. This measure results in an increase of the mass of the latch head and has not gained acceptance in practical applications.

U.S. Pat. No. 2,817,222 has disclosed the reinforcement of the back of the latch head with a rib that sinks into the latch slit in open position of the latch. This measure is to prevent any latch and jaw breakages.

DE Patent 27 14 607 has disclosed a damping of the impact of the needle latch in open position or rear position due to a special design of the longitudinal slit of the needle and to thereby avoid damage to the latch and the needle itself, such damage otherwise occurring in the rear position of the needle latch. To achieve this, a second longitudinal needle slit that has a length extending beyond the end of the opened latch adjoins the first longitudinal needle slit that receives the latch. As a result of this measure, the elasticity of the needle shaft jaws is increased. However, this measure is not sufficient to meet the current requirements expected of high-speed knitting machine needles.

SUMMARY OF THE INVENTION

Considering this, it is the object of the invention to provide a latch needle for a loop-forming machine, whereby this latch needle is to exhibit a reduced tendency to needle or latch breakage.

The inventive latch needle in accordance with claim 1 meets these expectations. This latch needle has on its latch needle back at least two first facets, which are, as in case of a conventional latch needle, arranged in a manner divergent in the longitudinal direction of the latch. Additionally provided are two other (second) facets located between the existing facets and the latch back. Extending from the latch back, they are divergent. Consequently, the facets are arranged in a manner inclined relative to an imaginary plane through the center axis. The opening direction of the preferably acute angle subtended by the first facets essentially corresponds to the longitudinal direction of the latch. The opening direction of the preferably acute angle subtended by the second facets essentially corresponds to a direction that diverges from the longitudinal direction of the latch and is located in the center plane. The two first facets are preferably arranged symmetrical with respect to the center plane. The two second facets are preferably also arranged symmetrical with respect to the center plane. These facets may be flat or even rounded. In so doing, a concave curvature is preferred. The facets are provided on the end of the latch head that has a spoon-like configuration and that adjoins the latch shaft. The latch shaft has a width which is slightly less than the width of the latch slit, so that the latch is movably held in the latch slit. The width of the latch head projects beyond the latch slit and also beyond the hook of the latch needle in order to ensure a smooth casting off of the half loop over the latch head.

The second facets result in a reduction of the weight of the latch head, thus reducing the kinetic energy of said head. In addition, the molded impression to be provided on the needle body can be smaller than until now, thus reducing the otherwise existing weakening of the needle body at this point.

Both the first facets form a transition region from the relatively narrow latch shaft to the wide latch head. Part of this transition region may sink into the latch slit and/or into the pickup funnel of the needle base body. In so doing, this transition region of the latch preferably has a first and a second facet per side. Starting from the flat side of the latch shaft, said shaft's width is initially increased by the first facets that, together, form a wedge, until the maximum width of the latch head is reached. The second, preferably longitudinal, facet adjoins the preferably essentially triangular first facet, as a result of which the cross-section of the latch head in the transition region of the latch shaft is reduced toward the latch head. The transition region of the latch shaft is in the region of the receiving funnel, the size of which, in particular its width, can be reduced as a result of this. The second facet is arranged at an oblique angle relative to the first facet. Both facets may seamlessly merge so that the loops may slide over the latch back without being impaired. The transition of the two molded surfaces into each other can be configured, e.g., rounded, in such a manner that it is not possible to define an exact boundary of the two molded surfaces. In addition, the facets with the rounded borders and edges may terminate in the remaining latch back.

Due to the second molded surface, the cross-section or the volume of the latch head is reduced in the section of the latch head that sinks, in open position, into the receiving funnel of the shaft jaws or comes into contact with said shaft jaws. Consequently, the width of the receiving funnel can be reduced. As a result of this, the upper side of the needle shaft jaw may be wider. This results in a strengthening of this critical region of the needle base body, which otherwise represents a weak point.

The receiving funnel, i.e., the so-called molded impression, can be adapted to the back of the latch head. The shape corresponds, in the region where the latch head is supported by the surfaces of the molded impression, to the shape of the latch head. As a rule, the latch head has a curved form following a radius. At the point where the receiving funnel terminates in the upper side of the shaft jaws, said funnel may have at least a partial surface. This partial surface is preferably aligned parallel to the second facet of the latch head. A section through the receiving funnel is then bordered by a curve that consists of one arcuate section and of two straight sections. Consequently, the latch head has available a receiving funnel which, at its lowest point in the center, follows an arc, e.g., a circular arc, i.e., it is curved, and is flat on its ends. This receiving funnel may essentially be adapted to the shape of the latch head in this region.

Additional details of advantageous embodiments of the invention are obvious from the drawings, the description and/or the claims.

BRIEF DESCRIPTION OF THE DRAWINGS

The drawings show exemplary embodiments of the invention.

DETAILED DESCRIPTION OF THE INVENTION

Figure 1:
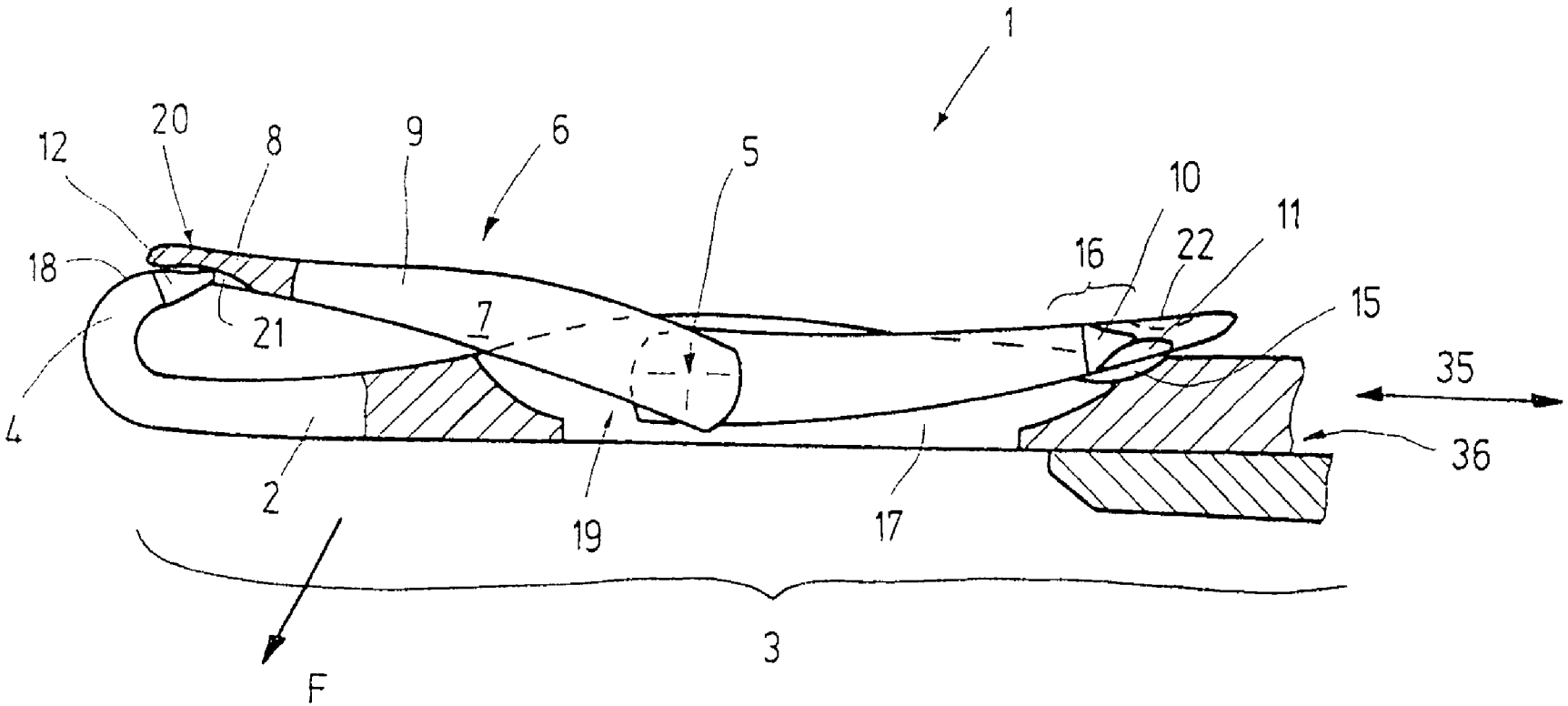
FIG. 1 is a detail of a schematic side view of a latch needle having a small groove-like recess and having an improved transition region between the latch shaft and the latch head, in closed and rear positions of the latch.

FIG. 1 shows a latch needle 1 comprising a needle body 2 with a loop-forming part 3 having a hook 4 on its end side. The hook 4 is provided with a tip 12 that may be rounded on its upper side 18.

On its loop-forming part 3, the needle body 2 has a latch slit 17 into which extends an end 19 of a latch 6. The latch 6 is held and pivotally supported in the latch slit 17 on a bearing arrangement 5. The bearing arrangement 5 is formed, e.g., by a bearing shaft extending through the latch slit 17. This bearing shaft may possibly represent a bearing pin or preferably have the form of a one-part or multi-part pin that may be seamlessly joined to the needle body 2. The latch 6 is supported so that it can be pivoted about this bearing arrangement 5, from a closed position on the left side in FIG. 1 into a rear position illustrated on the right side in FIG. 1.

The latch comprises a narrow shaft 9 that is preferably limited by parallel flanks and has a width that is slightly smaller than that of the latch slit 17. The length of the latch 6 is such that its end 20 can reach, and partially reach around, the upper side 18 of the hook 4. In so doing, the end 20 is provided with a depression 21 on the side facing the hook 4, whereby said depression—in accordance with the exemplary embodiment in accordance with FIG. 1—forms an indentation 22 for the accommodation of at least a section of the hook 4. The indentation 22 may correspond to the shape of the upper side 18 of the hook 4 and may be adapted thereto. The latch needle 1, in particular the needle body 2, is movably held in a needle support 36. The needle support 36 may end approximately at the axial position where the latch head 8 in rear position interacts with the needle base body 2. The needle base body 2 is supported by the needle support 36 at that point, in particular when the needle is subjected to the tensile forces F of the material take-down.

Figure 2:
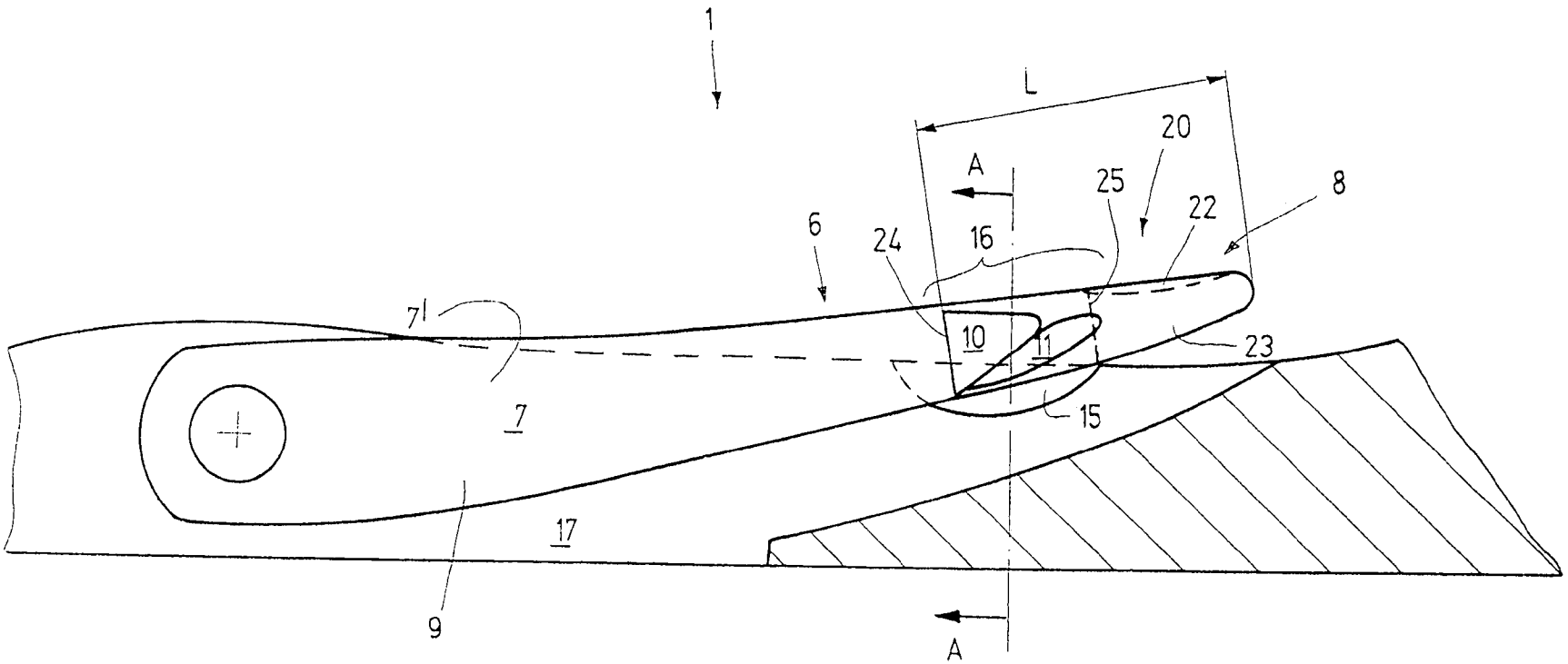
FIG. 2 is a schematic side view of the latch needle in accordance with FIG. 1, with the latch in rear position and in a different scale.
Figure 3:
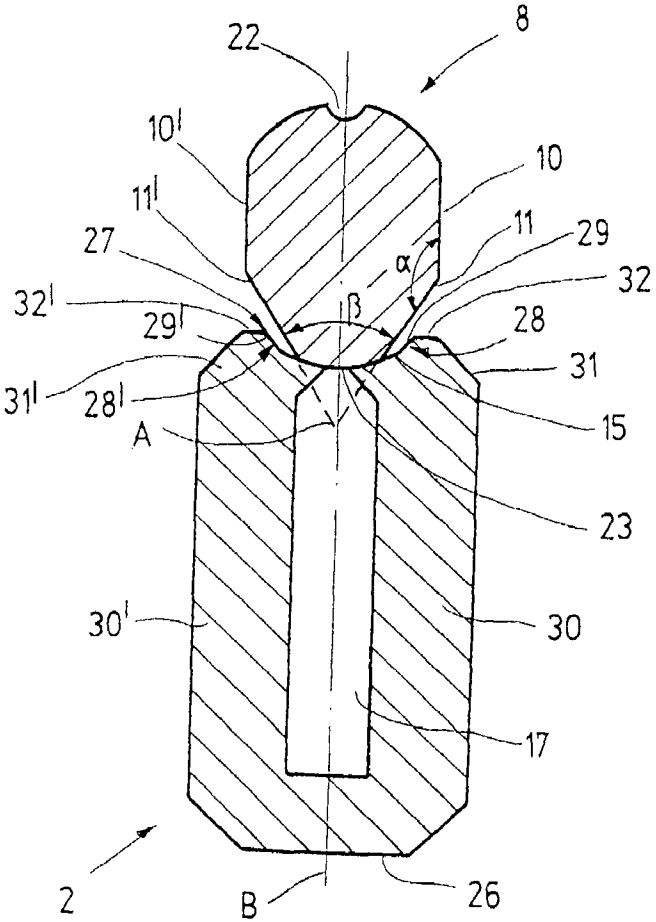
FIG. 3 is the latch in accordance with FIG. 2, in section, along line A-A and in a different scale.
Figure 5:
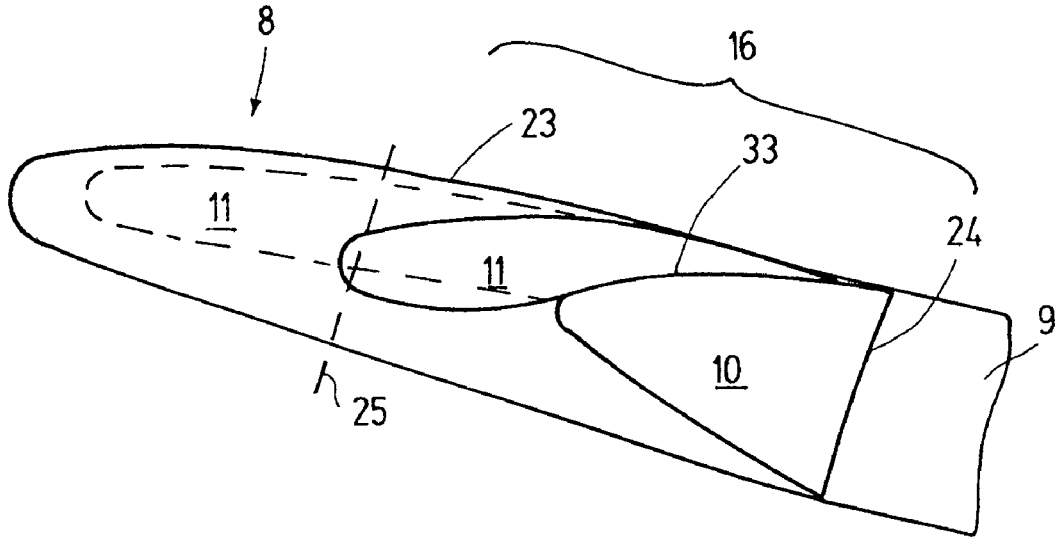
FIG. 5 is a detail of a side view of the latch needle having a small groove-like recess, in accordance with FIG. 1 in a different scale.
Figure 5A:
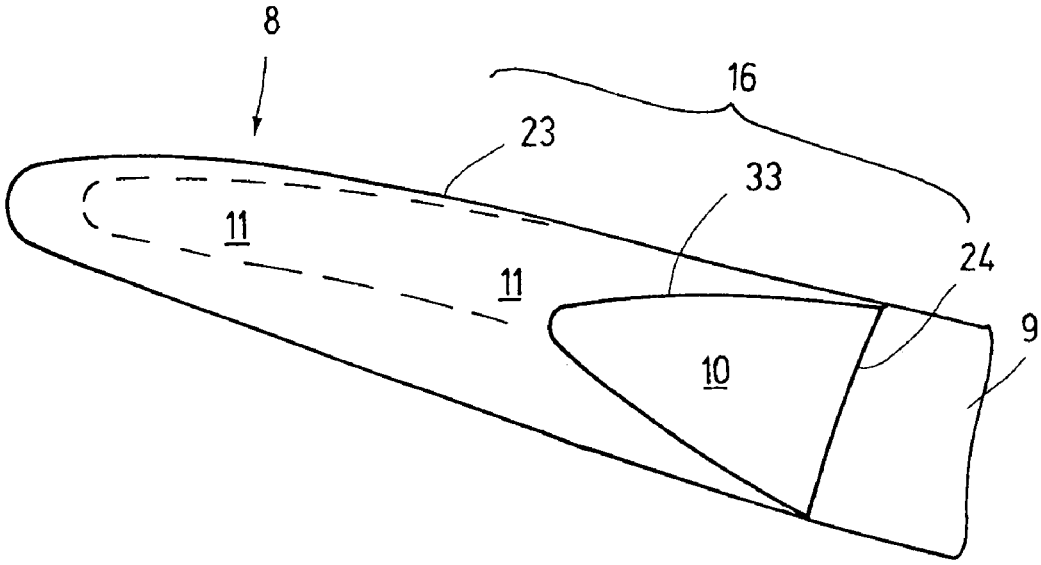
FIG. 5*a* is a detail of a side view of the latch of the prior-art latch needle.

The configuration of the end 20 of the latch 6 is also obvious from FIGS. 2, 3 and 5. The end 20 adjoins a back surface 23, which forms the rear side of a spoon provided on the end of the latch 6. The tip of the spoon marks the end 20 of the latch 6. Its width exceeds the width of the latch shaft 9 which has essentially parallel flanks. The latch shaft 9 having a width that is defined by the distance of its flat sides 7 and 7' from each other, merges at a line 24 with the transition region 16 in the latch head 8. The width of the latch head 8—measured perpendicularly to the flat sides 7, 7'—increases progressively, starting at the line 24, in axial direction or in the longitudinal direction of the latch. It reaches its maximum width at the dashed line 25 in FIGS. 2 and 5, said line intersecting the spoon. The (imaginary) line 25 is located approximately in the center of the latch head length L, which extends from the line 24 to the end 20 of the latch head 8. The widest part of the latch head 8 may also be shifted in the direction of the line 24, so that said point is not in the center of the latch head length L.

The increase of the width of the latch head 8 is defined (as shown by FIG. 2) by the first facet 10. The edge of the facet 10 preferably defines an isosceles triangle. The facet 10 is preferably flat. It is also possible to provide it with a convex or even a concave curvature.

Adjoining the facet 10, the latch head 8 has a second facet 11. This facet 11 is located above the receiving funnel 15 of the needle body 2 when the latch 6 is in rear position. This second facet 11 represents a longitudinal molded surface which, as is obvious from FIG. 3, extends at an oblique angle a relative to the first facet 10. The length of the facet 11 to be measured in longitudinal direction of the latch can extend up to the line 25 or, optionally, even slightly beyond said line (FIG. 2). Also, exemplary embodiments are conceivable, wherein the facet 11 extends almost along the entire length of the latch head. Then, it is sufficient if, starting at the molded surface 10, it extends up to the end 20 of the latch head 8 and ends at the indentation 22, which is close to the latch head.

FIG. 3 shows an exemplary embodiment where the latch head 8 comprises two first diverging facets 10, 10', which intersect sect the plane of projection oriented transverse to the longitudinal direction of the needle respectively in a line located parallel to a plane B, which, in turn is parallel to the flat sides 7, 7' of the latch shaft 9. Adjoining the first facets 10, 10', the latch head 8 has, on each side of the plane B, respectively one second flat facet 11, 11'. Together, the two facets 11, 11' subtend an acute angle β. As a result of this, the cross-sectional area and the volume of the latch head 8 are reduced in the transition region 16, which interacts with the receiving funnel 15 or in which said region it is supported in the receiving funnel 15. The location of the facet 11 is selected in such a manner that an imaginary extension going beyond the back surface 23 intersects the latch slit 17 in the direction of the needle body 2. Tangents of the facets 11, 11' placed on the facets in the plane of projection form a point of intersection A. This point of intersection A preferably is located on the center plane B and is varied as a function of the angle β. The distance between the point of intersection A and the back 23 of the needle latch 6 is preferably at least half that of the thickness of the latch shaft 9.

Figure 4:
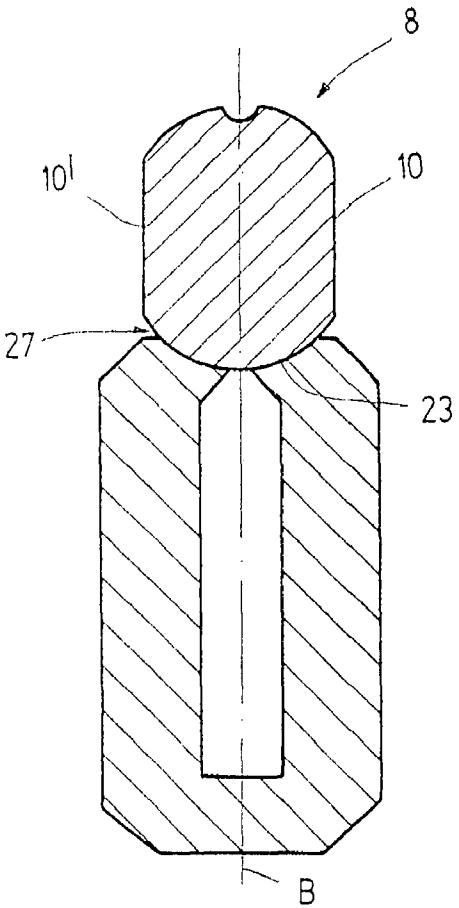
Prior Art Fig.4
FIG. 4 is a section of a prior-art latch needle in accordance with FIG. 3.
Figure 7:
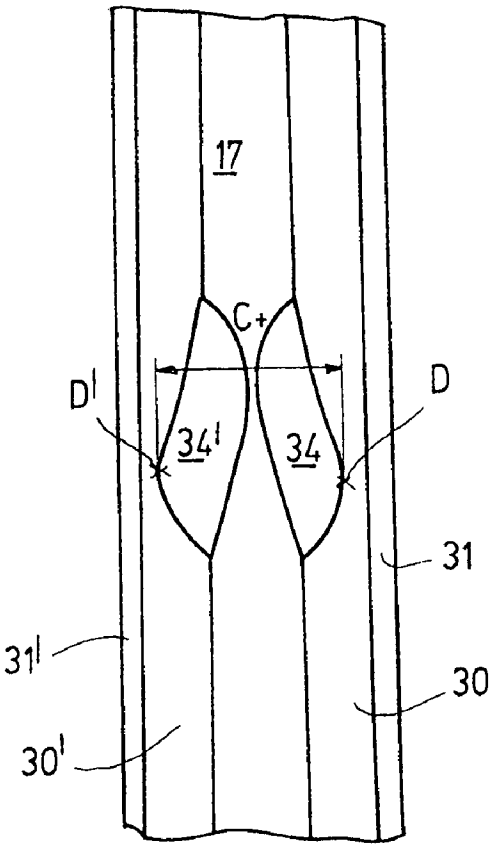
Prior Art Fig.7
FIG. 7 is a plan view of the molded impression as in a prior-art needle, in enlarged scale.

The receiving funnel 15 is represented by a recess 27, which is adapted to the back surface 23 in the transition region 16 of the latch head 8. In so doing, the receiving funnel 15 has at its lowest point near the center plane B a curvature, which essentially corresponds to the curvature of the adjoining part of the back surface 23 of the latch head 8. In the edge region 28, 28' of the receiving funnel 15, said funnel has two partial surfaces 29, 29', which are essentially configured parallel to the second facets 11, 11'. The receiving funnel 15 has, measured transversely with respect to the center plane B, a width C (FIG. 3*a*), which is substantially smaller than in a prior-art receiving funnel (FIGS. 4, 4*a* and 7). The width of the upper sides 32, 32' of the needle shaft jaws 30, 30' adjacent to the receiving funnel 15 is defined by the size of the bevel 31, 31' and the width C of the receiving funnel 15. This width of the upper side 32, 32' is significantly greater, at least 1.5 times greater, compared with the width of one upper side 32 of a prior-art needle (FIGS. 4, 4*a* and 7). As a result of this, the stability of the shaft jaws 30, 30' is increased in this region, and thus the overall stability of the needle body 2 is increased.

Figure 6:
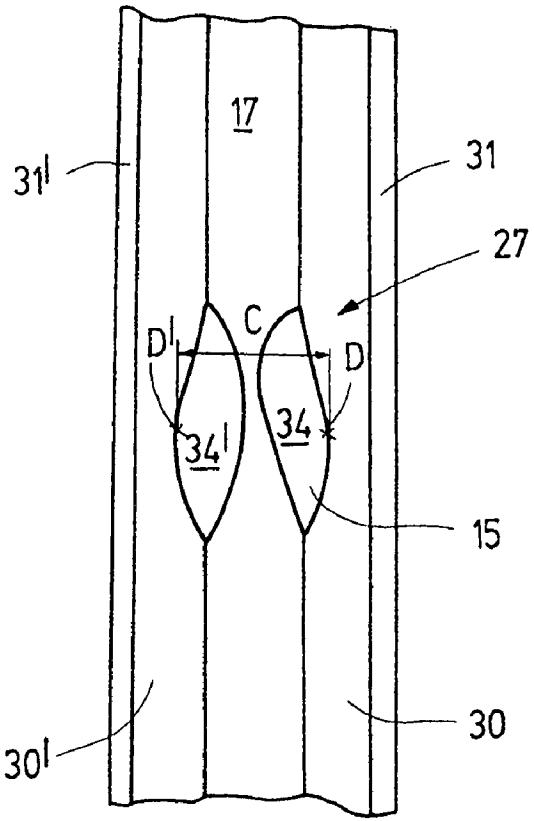
FIG. 6 is a plan view of the molded impression as in the latch needle in accordance with FIG. 1.

The receiving funnel 15 is manufactured by means of a non-cutting machining process. Consequently, the material of the region of the needle shaft jaw 30, 30' can be moved in the direction of the latch slit 17. As a result of this, a support surface is created in the receiving funnel 15 above the latch slit 17. The material can be shifted in such a manner that the edges of the projections formed on the shaft jaws 30, 30' almost touch in the region of the center plane B (FIG. 6).

Figure 3A:
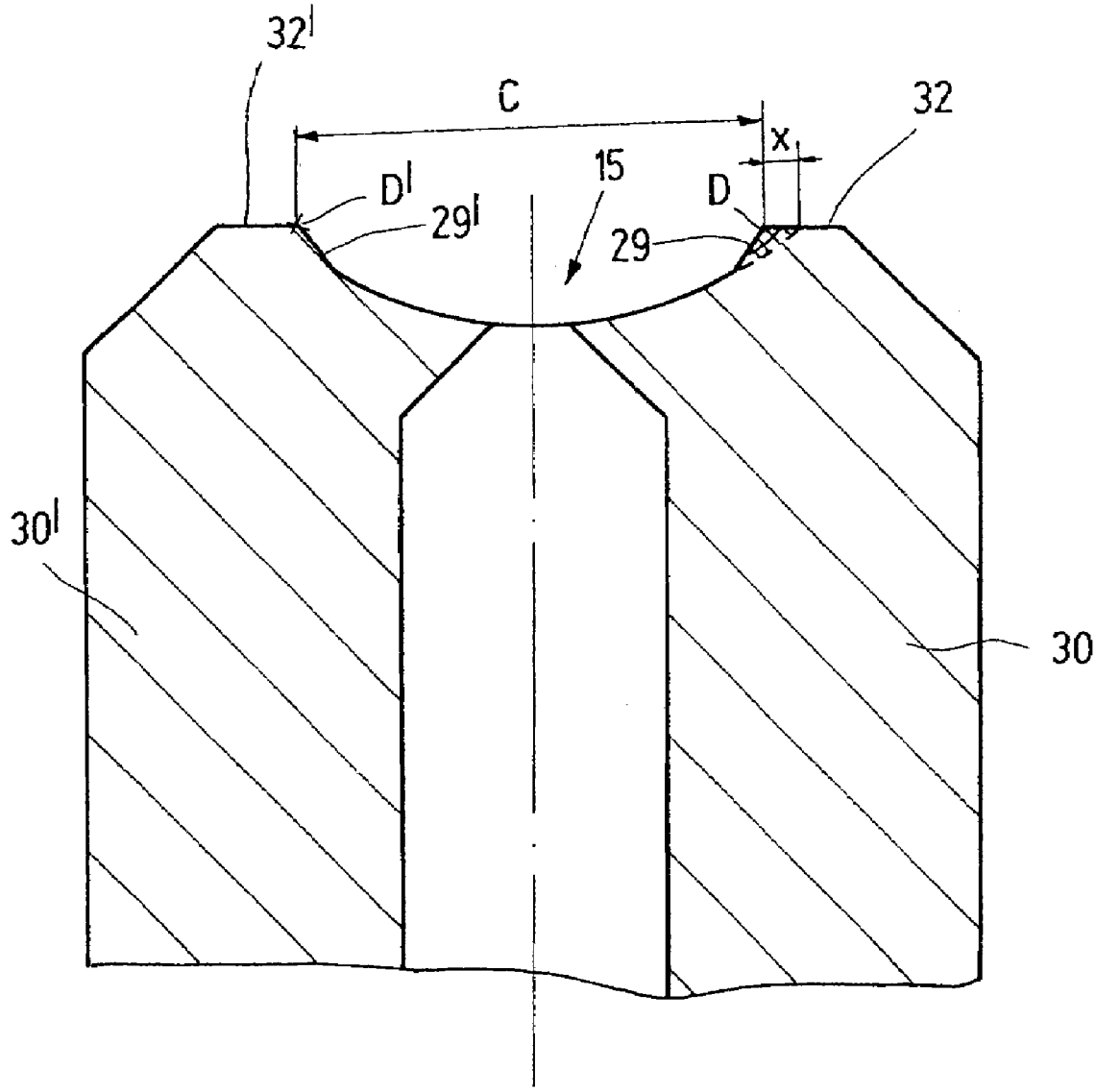
FIG. 3*a* is an enlarged illustration of the pickup region of a latch needle in accordance with FIG. 3.
Figure 4A:
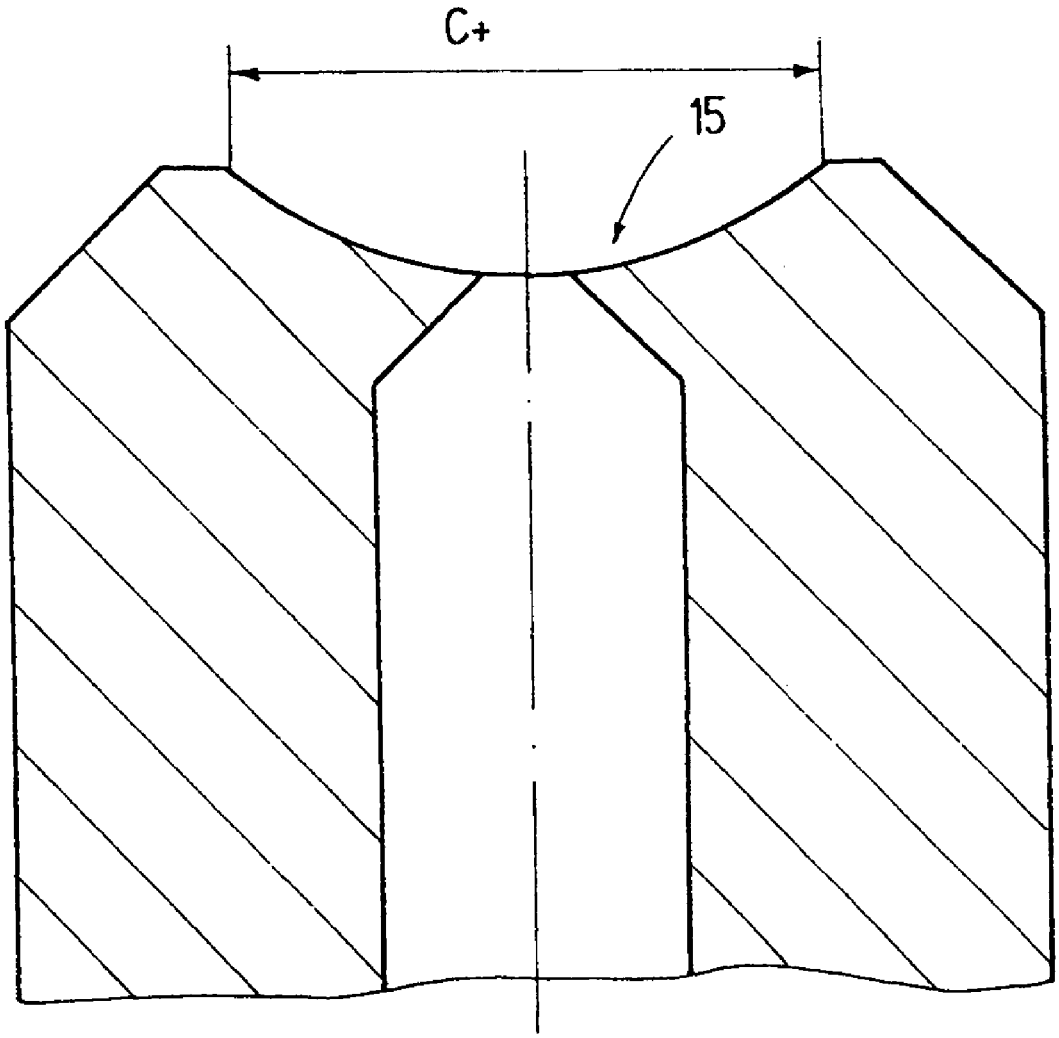
Prior Art Fig.4a
FIG. 4*a* is an enlarged illustration of the pickup region of a prior-art latch needle in accordance with FIG. 4.

FIG. 3*a* shows the width C of the receiving funnel 15. A border D is located between the upper side 32 and the receiving funnel 15. A border D' is located between the upper side 32' and the receiving funnel 15. The width C of the receiving funnel 15 should be measured from the border D to the border D'. The width C of the receiving funnel 15 is substantially smaller than in a prior-art needle (FIGS. 4, 4*a* and 7). This is achieved by providing the partial surface 29, 29' in the recess 27. The rounding of the receiving funnel 15, which, in a prior-art needle corresponds to the rounding of the back surface 23 of the latch head 8, is interrupted by the partial surfaces 29, 29'. FIG. 3 a shows, as an example, on the right needle shaft jaw 30—in dashed illustration—the imaginary extension of the otherwise uniformly rounded surface of the receiving funnel 15. Due to the partial surfaces 29, 29' which deviate from the otherwise rounded configuration, the width C of the receiving funnel 15 can be made smaller by two times the distance C, compared with conventional mold impressions. The distance X represents the distance between the border D and the end of the receiving funnel 15 without partial surfaces 29, 29', in accordance with prior art. As a result of the reduction of the width C of the receiving funnel 15, the widths of the upper sides 32, 32' of the needle shaft jaws 30, 30' can be increased by the amount X.

As a result of the location of the facets 11, 11' (FIG. 3), the cross-sectional area and the volume of the latch head 8 are considerably reduced. A comparison of an inventive needle in accordance with FIG. 3 with a needle in accordance with prior art clearly illustrates this reduction of volume or cross-sectional area.

As is obvious from FIG. 5, a transition 33 is provided between the facet 10 and the facet 11 of the latch head 8. This transition 33 may be configured as a rounded or flattened edge that does not impair loop formation. The transition 33 can also be configured as a flat surface or as another facet. It is disposed to provide the gentle transition of the facet 10 to the facet 11. A distinct boundary between the facet 10 and the facet 11 can then no longer be seen.

Furthermore, FIG. 5 shows an alternative embodiment of the facet 11 as indicated in dashed illustration. This alternative facet 11 extends—starting from the facet 10—almost along the entire length of the latch head 8 and follows the lateral curvature of said latch head. Considering the design of the facet 11, the requirements of the loop-forming process may be taken into consideration.

FIG. 6 shows a plan view of the recess 27 of the receiving funnel 15. It can be formed by a reforming process from the shaft jaws 30, 30' and may have two rounded surfaces 34, 34'. The edge of the surface 34 is preferably rounded on the side facing the bevel 31. This considerably increases the stability of the knitting machine needles in this region, when compared with prior art and FIG. 7. The same applies alternately to the molded surface 34'. The risk of forming an undesirable weak point due to a corner in the edge of the surface 34, 34' or in the recess 27 (FIG. 7) is thus considerably reduced.

The latch needle 1 described so far is disposed to operate as follows:

In operative mode, the latch needle 1 in accordance with FIG. 1 is moved back and forth in longitudinal direction as indicated by an arrow 35. In so doing, the latch continuously moves back and forth between the closed position (FIG. 1, left side) and the rear position (FIG. 1, right side). In closed position, the depression 21 partially extends around the hook 4. In the rear position, in contrast, the hook 4 is cleared. During the back and forth movement, the latch 6 gains kinetic energy which, when impacting in the rear position or when impacting on the hook 4, results in a shock-type stress on the hook 4 and the latch 6. In so doing, the facets 11, 11', compared with a latch 6 having the same form, considerably reduce—without such surfaces—the volume of the latch head 8 and thus the kinetic energy that is to be converted. In addition, due to the adapted narrowed form of the receiving funnel 15, the latch needle 1 is reinforced and can thus better receive and absorb the kinetic energy. This results in a smaller load application to the upper side 18 of the hook 4, as well as to the region of the recess 27 in rear position of the latch needle 1. This results in a diminishing of the impact of the shock acting on the latch 6 and on the needle body 2, thus reducing the number of breakages in the region of the latch shaft 9 and of the needle body 2.

The latch needle 1 in accordance with the invention has a latch 6 being provided on its latch spoon on the side facing away from the hook 4, with at least two facets or molded surfaces 10, 11. These facets 11, 11', which converge toward the latch back 23, decrease the volume of the latch head 8. Consequently, it is possible to reduce the width C of the recess 27, thus resulting in a stabilization of the knitting machine needle 1 in this region.

It will be appreciated that the above description of the present invention is susceptible to various modifications, changes and adaptations, and the same are intended to be comprehended within the meaning and range of equivalents of the appended claims.

LIST OF REFERENCE NUMBERS

1 Latch needle
2 Needle body
3 Loop-forming part
4 Hook
5 Bearing arrangement
6 Latch
7, 7' Flat side
8 Latch head
9 Latch shaft
10, 10', 11, 11' Molded surfaces/facets
12 Tip
15 Receiving funnel
16 Transition region
17 Latch slit
18, 37 Upper side
19, 20 End
21 Depression
22 Indentation
23 Back surface, latch back
24, 25 Line
26 Needle back
27 Recess
28, 28' Edge region
29, 29' Partial surface
30, 30' Needle shaft jaws
31, 31' Bevel
32, 32' Upper side
33 Transition
34, 34' Surface
35 Arrow
36 Needle support
A Point of intersection B Center plane
C, C+ Width D, D' End
F Take-down force L Length of latch head
X Distance $\alpha$ Angle
$\beta$ Angle

The invention claimed is:

1. Latch needle for a loop-forming textile machine, comprising a needle body having a loop-forming part with a hook, a latch slit, a bearing arrangement arranged in the latch slit, and a receiving funnel, a latch having a latch shaft that is pivotally supported on the bearing arrangement and supports a latch head having a transition region with sides facing away from each other, by which the latch shaft terminates in the latch head which has a greater width, a respective first facet located on each side of the transition region of the latch head, whereby the latch is supported so as to pivot between a closed position, in which it contacts the hook, and a rear position, in which at least a portion of a back surface of the latch head of said latch in said transition region interacts with and contacts the receiving funnel, which has a surface curvature corresponding to that of the contacting portion of the back surface; and wherein, at the portion of the back surface in the transition region of the latch head, at least one second facet is provided adjoining each first facet and reducing the width of the portion of the transition region at the back surface, and the surface curvature of the funnel is reduced adjacent outer edges of the funnel.

2. Latch needle in accordance with claim 1, wherein the first facet terminates in a wider flat side of the latch shaft.

3. Latch needle in accordance with claim 2, wherein the first facet is a flat surface and is arranged at an oblique angle relative to a flat side of the latch shaft.

4. Latch needle in accordance with claim 1, wherein the first and second facets merge.

5. Latch needle in accordance with claim 1, wherein the cross-section of the latch head is limited in the transition region by at least two facets and by the back surface.

6. Latch needle in accordance with claim 5, wherein the cross-section of the latch head is limited in the transition region by at least four facets and by the back surface.

7. Latch needle in accordance with claim 6, wherein, on each side of the latch, respectively one first facet is provided, and that the two first facets intersect a transverse plane at lines that are parallel to each other.

8. Latch needle in accordance with claim 1, wherein the first facet and the second facet form an oblique angle ($\alpha$).

9. Latch needle in accordance with claim 1, wherein a minimum of one second facet is arranged on the latch head such that a tangent applied to the second facet intersects the latch slit when the latch head has been received by the funnel.

10. Latch needle in accordance with claim 1, wherein the second facets are arranged on the latch head such that, together, tangents applied to the second facets and pointing into the latch slit subtend an acute angle ($\beta$).

11. Latch needle in accordance with claim 1, wherein the surface of the funnel adjacent the respective outer edges has portions that extend parallel to the respective second facets.

* * * * *